United States Patent [19]

Walmer

[11] 4,094,090

[45] June 13, 1978

[54] DOLL HOUSE

[76] Inventor: Harry E. Walmer, 721 N. Overlook Dr., Alexandria, Va. 22305

[21] Appl. No.: 767,959

[22] Filed: Feb. 11, 1977

[51] Int. Cl.[2] ..... A63H 3/52

[52] U.S. Cl. ..... 46/19

[58] Field of Search ..... 46/21, 30, 31, 18, 19; 35/16

[56] References Cited

U.S. PATENT DOCUMENTS

| | | | |
|---|---|---|---|
| 311,793 | 2/1885 | Stranders | 46/19 |
| 3,970,399 | 7/1976 | Palumbo | 46/31 X |
| 3,996,693 | 12/1976 | Walmer | 46/19 |
| 4,018,001 | 4/1977 | Walmer | 46/19 |

FOREIGN PATENT DOCUMENTS

| | | | |
|---|---|---|---|
| 459,308 | 1/1937 | United Kingdom | 46/31 |

*Primary Examiner*—Russell R. Kinsey
*Assistant Examiner*—Mickey Yu
*Attorney, Agent, or Firm*—M. Ted Raptes

[57] ABSTRACT

The invention relates to a doll house having a unique construction of a porch roof with columns in the front. The doll house is of the collapsible type having a novel design in its construction. It is constructed of a small number of individual panels which comprise the walls, floors, roof, etc. The panels are provided with grooves and slots so that all the panels slide together easily and support one another. No tools or screws are required for construction and the parts are locked tightly together in a rigid structure by the simple insertion of several small pegs in matching holes provided in the various panels. The doll house has a series of decorative columns combined with a porch roof on the front of the house and a unique assembly thereof is disclosed.

8 Claims, 16 Drawing Figures

DOLL HOUSE

BACKGROUND OF THE INVENTION

This invention relates to a doll house or toy house of the knock-down or collapsible type having a pleasing front porch with columns design and simplified construction, capable of being easily constructed or taken apart.

There have been developed various types of doll houses to provide recreation and education to children and adults. Many of these doll houses are of the permanent type presenting problems with respect to shipping and storage. Others, which are of the knock-down type are relatively complicated in construction and require various types of fasteners and locking members to hold the doll house together. These doll houses, for the most part require tools and screws for construction and lack the desired rigidity when constructed. Furthermore, more sturdy types of doll houses, which can be easily knocked-down, are desired by various adult hobbyists. These doll houses are required to have open access to the various floors in order that the hobbyists can set up various furniture arrangements, etc. Interior decorators also find the doll houses useful in planning the furniture arrangements, etc., of rooms. In particular, a doll house having a porch with columns has not been easy heretofore to construct in a knock-down type.

BRIEF SUMMARY OF THE INVENTION

Generally, the present invention provides a unique design for a knock-down construction of a doll house. The doll house is constructed with a unique porch roof with columns and a small number of panels provided with grooves and slots so that all parts of the house slide together easily and support one another. Columns are provided in the front of the house which are easily assembled with a unique porch roof. The entire doll house assembles easily in minutes using no tools or screws, and once assembled, all the parts are locked tightly together to provide a rigid, sturdy structure by the simple insertion of several small pegs strategically arranged with respect to the structure of the doll house.

It is, therefore, an object of this invention to provide a doll house having a unique porch and columns construction design capable of being easily constructed without special skill or the use of tools and fasteners, and which can be easily disassembled or knocked-down for storage or transport purposes.

Another object of this invention is to provide a doll house that is relatively rigid and sturdy in construction when assembled, requiring only simple pegs for holding the assembled house together.

A further object of this invention is to provide a doll house constructed from novel arrangement of panels provided with grooves and slots whereby construction or disassembly of the doll house is facilitated.

Another object of this invention is to provide a novel column construction with a porch for a doll house whereby the columns are held in place between a porch roof and the first floor at the front of the doll house.

Another object of this invention is to provide a novel rear transparent viewing panel which is adapted to be installed at the rear of the doll house through which the contents of the doll house can be viewed and protected.

Other objects, advantages and features of the invention will become apparent from the following detailed description of a preferred embodiment of the invention when considered with the accompanying drawings.

DETAILED DESCRIPTION OF THE INVENTION

Figure 1:
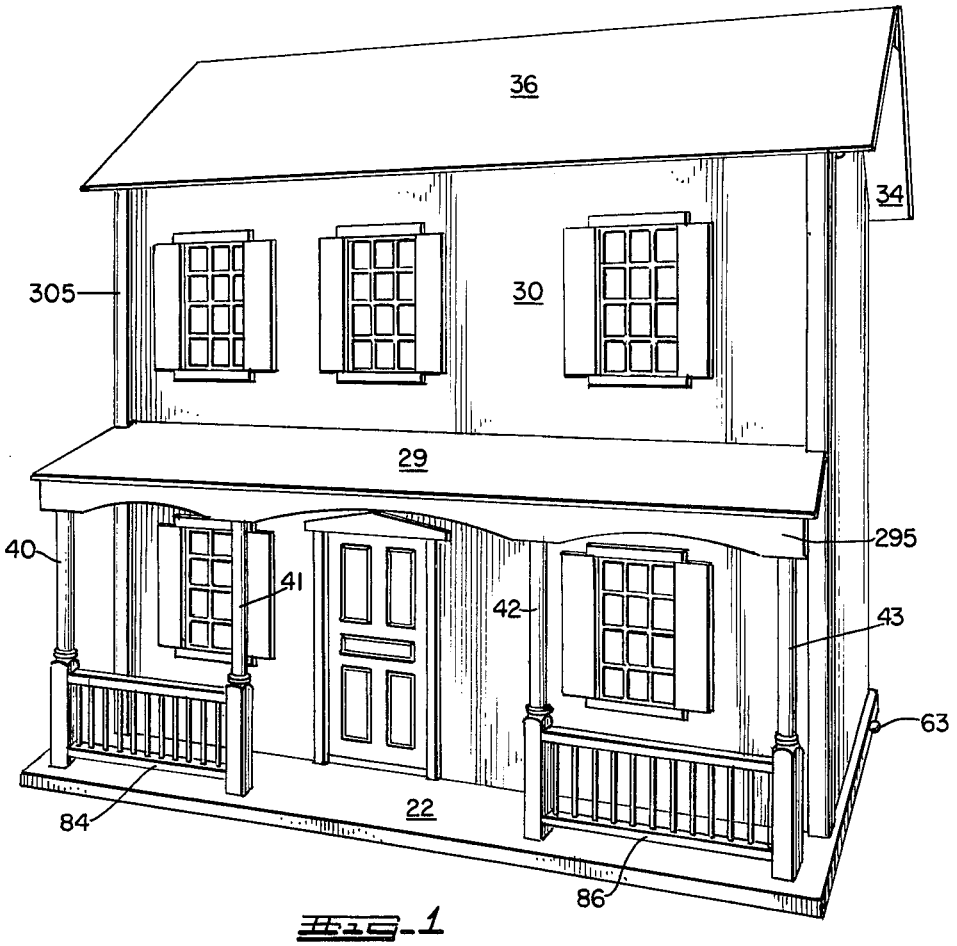
FIG. 1 is a perspective view of the front of the doll house as fully assembled embodying the novel aspects of the invention.
Figure 4:
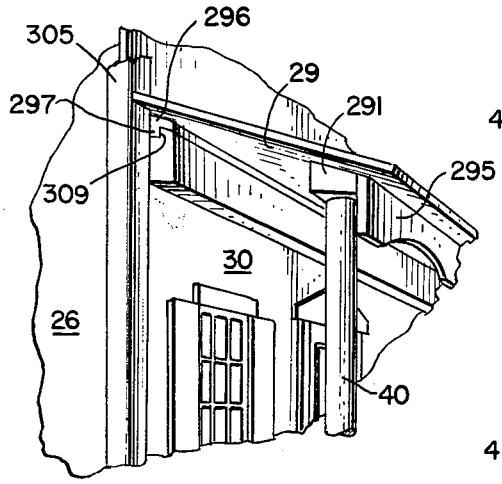
FIG. 4 is an enlarged perspective fragmentary view, as seen from a front corner of the doll house, of the front wall, right side wall, and front porch roof and one column of the doll house disclosing details of the assembly thereof.
Figure 2:
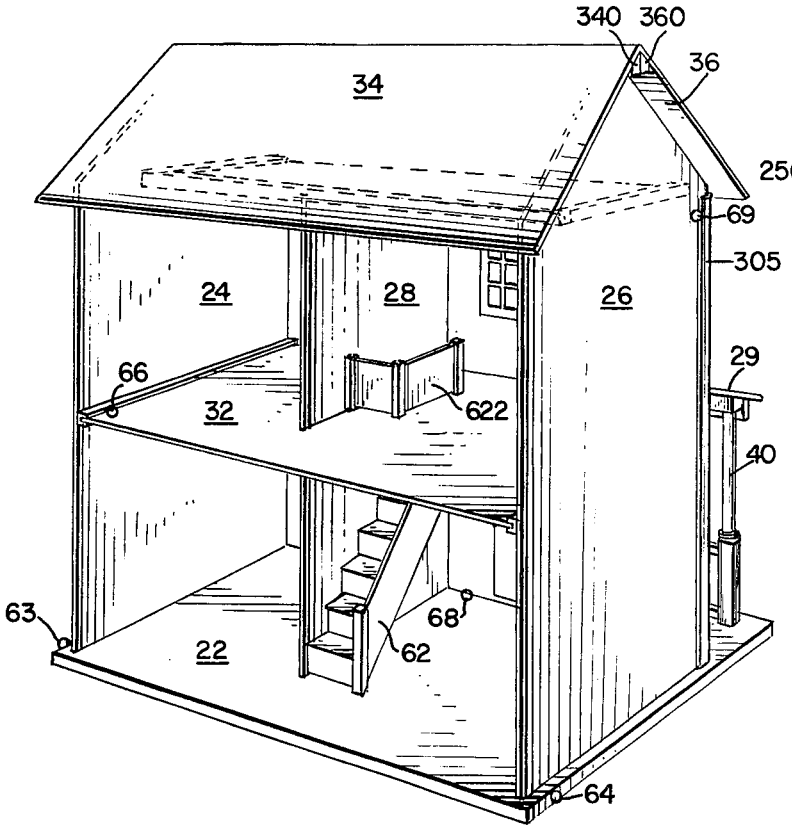
FIG. 2 is a perspective view of the rear of the doll house fully assembled disclosing the interior rooms thereof.
Figure 3:
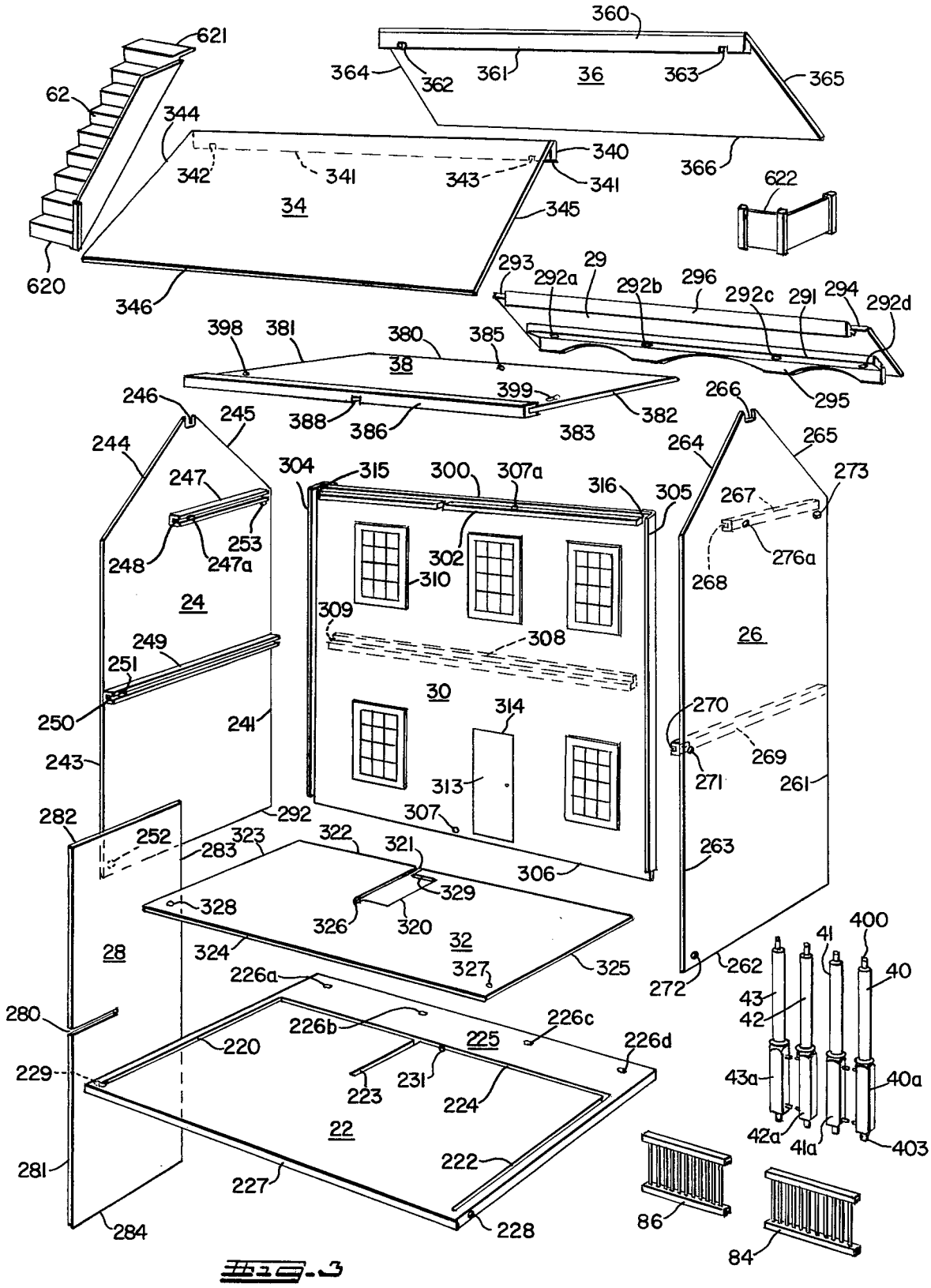
FIG. 3 is an exploded perspective rear view as seen from the rear as in FIG. 2 disclosing front, left and right side walls as well as the floors, roof, front porch elements, and various parts of the doll house.

Referring to the drawings, FIG. 1 shows a perspective generally front view of a doll house embodying the principles of the invention and FIG. 2 shows a generally perspective rear view of the doll house. Both views show the doll house fully assembled and ready for use as a recreational device or as a model house for display purposes with furniture arrangements, etc. FIG. 3 is an exploded perspective rear view disclosing the various parts of the doll house and the manner in whcih the parts are assembled together.

The doll houses comprises a rectangular base or first floor member 22 having grooves 220, 222, 223, and 224 in the top surface, front porch portion 225 containing column holes 226*a–d*, and rear edge 227 and peg holes 228, 229 and 231. A left side wall member 24 comprises bottom edge 292, front edge 241, rear edge 243, an integral second floor horizontal beam member 249 containing a groove 250, an integral third floor horizontal beam member 247 with groove 248 and peg holes 247*a*, 251, 252, and 253. The top portion of the left wall comprises slanted edges 244 and 245 with a slot 246 at the top. Similarly, a right side wall member 26 comprises bottom edge 262, front edge 261, rear edge 263, second floor horizontal beam member 269 with groove 270, integral third floor horizontal beam member 267 with groove 268, peg holes 276*a*, 271, 272, and 273, and slanted edges 264 and 265 with slot 266.

Figure 13:
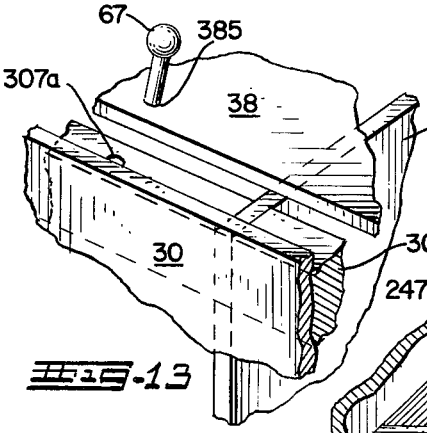
FIG. 13 is an enlarged perspective fragmentary exploded view, with the roof removed, as seen from the left front, of the front wall, intermediate wall, and third floor of the doll house disclosing details of the assembly thereof and showing the manner in which they are held together by a peg.
Figure 8:
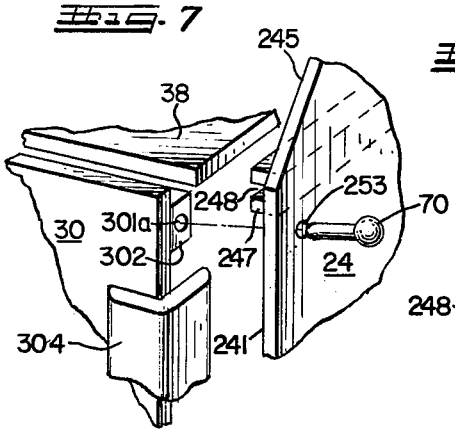
FIG. 8 is an enlarged perspective fragmentary exploded view, with the roof removed, as seen from the left front, of the front wall, left side wall, and third floor of the doll house disclosing details of the assembly thereof.

A front wall member 30 comprises top edge 300, bottom edge 306 and integral, L-shaped left and right corner vertical beam members 304 and 305. Across the top of the inside of the front wall edge 300, a horizontal beam 302 is disposed containing a vertical slot 312. Slots 315 and 316 are between beam 300 and the beams 304 and 305, respectively. A horizontal beam member L-shaped beam member 308 is disposed across the front side of wall 30 and a horizontal slot 309 is defined by the beam 308 and the wall 30. Windows 310, doorway 314 and a door 313 are also disposed in the front wall member. Peg hole 301*a* (FIG. 8) is provided at one end of beam 302 and similarly a second peg hole (not shown) is provided at the other end of the beam. A peg hole 307*a* (FIGS. 3 and 13) is provided in the top of beam 302 and a peg hole 307 is provided at the bottom of wall 30.

A porch roof member 29 adapted to be installed on beam 308 of wall 30 comprises a forward horizontal beam member 291 having holes 292*a–d* on the inside thereof, and a decorative vertical cornice 295 adjacent thereto. A T-shaped beam member 296 is disposed horizontally along the rear edge of the porch roof and notches 293 and 294 are disposed at each end of the beam each formed by the end of the beam and the rear edge of the porch roof.

An intermediate wall member 28 comprises front edge 283, rear edge 281, bottom edge 284, top edge 282, and horizontal slot 280.

A second floor member 32 comprises front edge 322, rear edge 324, left and right side edges 323, and 325, and stair well 320 having open end slot 321 and slot 326, landing 329 and peg holes 327 and 328.

An attic or third floor member 38, comprises a front edge 380, rear edge 383, left and right sides edges 381 and 382 and peg holes 385, 398 and 399. A rear horizontal beam 386, containing slot 388 on the underside, is integral with rear edge 383.

A rear roof member 34 of the house comprises bottom edge 346, left and right side edges 344 and 345, and a top beam member 340 with edge 341 having slots 342 and 343. A similar front roof member 36 of the house comprises bottom edge 366, left and right side edges 364 and 365, and a top beam member 360 with edge 361 having slots 362 and 363.

As shown in FIGS. 1 and 3, a series of decorative support columns and posts 40–43 are adapted to be disposed in the front of the doll house between the front beam of porch roof 29 and the first floor 22. Each column, e.g. 40, comprises a post 40*a*, a bottom peg 403, top peg 400, and side extending pegs 401 and 402.

Decorative porch rails 84 and 86 are adapted to be disposed between posts 40*a* and 41*a* and posts 42*a* and 43*a*, respectively. A staircase 62 with guard rail 622 are adapted to be disposed in the doll house between the first and second floors.

Figure 7:
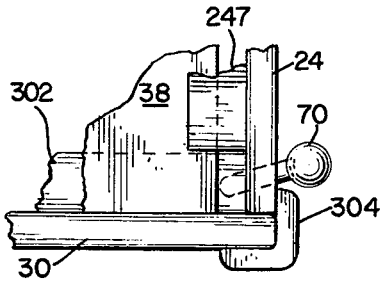
FIG. 7 is an enlarged fragmentary top view of a front corner of the doll house disclosing details of the assembly thereof.

The various parts of the doll house are adapted to be assembled together and held together with pegs. The bottom edge 306 of front wall 30 is inserted in groove 224 of the first floor 22, and edges 292 and 262 of side walls 24 and 26 are inserted in grooves 220 and 222, respectively. The front edges 241 and 261 of the walls 24 and 26 each fit within left corner beam 304 and slot 315 and right corner beam 305 and slot 316, respectively. The three walls are retained in place by inserting peg 63 in holes 229 and 252 of floor 22 and wall 24, and similarly, peg 64 in holes 228 and 272 of floor 22 and wall 26 (see FIG. 2); peg 70 in hole 253 of left wall 24 and hole 301*a* in the end of beam 302 (see FIGS. 7 and 8), and similarly, peg 69 in hole 273 of right wall 26 and a hole (not shown) in the end of beam 302; and peg 68 in hole 307 of wall 30 and hole 231 in groove 224 of floor 22.

Figure 9:
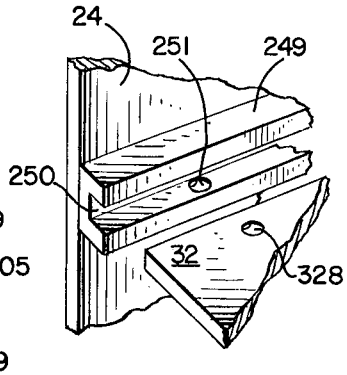
FIG. 9 is an enlarged fragmentary perspective exploded view of the left side wall and second floor disclosing details of the assembly thereof.
Figure 10:
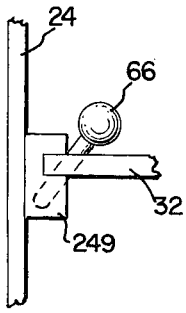
FIG. 10 is an enlarged fragmentary rear plan view of the assembled left side wall and second floor disclosing details of how they are held together by a peg.

Intermediate wall 28 is next inserted from the rear of the house, in groove 223 of floor 22, and also the front edge 283 is inserted in slot 312 of beam 302 of front wall 30. Second floor 32 is next assembled by sliding left and right side edges 323 and 325 simultaneously in grooves 250 and 270 of the side walls 24 and 26, respectively. The second floor is pushed forward until its front edge 322 abuts against wall 30 and, in so doing, slots 321 and 326 thereof are engaged with slot 289 of intermediate wall 28. The second floor 32 and intermediate wall 28 are retained in place by inserting peg 66 in hole 328 of the second floor and hole 251 in groove 250 of beam 249 of the left side wall (see FIGS. 9 and 10), and, similarly, a peg (not shown) is inserted in hole 327 of the second floor and hole 271 in slot 270 of beam 269 of the right side wall.

Figure 12:
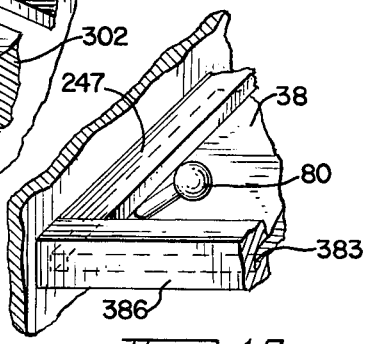
FIG. 12 is an enlarged perspective fragmentary view of the assembled left side wall and the third floor showing the manner in which they are held together by a peg.
Figure 11:
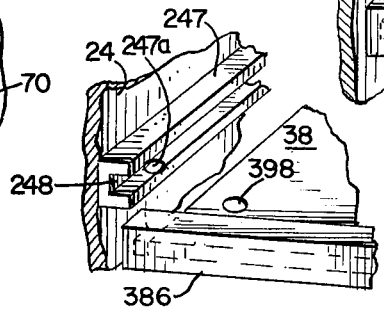
FIG. 11 is an enlarged perspective fragmentary exploded view of the left side wall and the third floor disclosing details of the assembly thereof.

The attic floor 38 is next assembled by inserting, from the rear of the doll house, edges 381 and 382 into grooves 248 and 268 of the beams 247 and 267, respectively, of the two side walls. At the same time, slot 388 of the floor beam 386 engages the top edge 282 of intermediate wall 28, respective. The attic floor is pushed towards the front of the house until edge 380 abuts the top of the front wall 30 aboce beam 302 (see FIGS. 7 and 8). The attic floor is retained in place by inserting a peg 67 in hole 385 of floor 38 and hole 307*a* of beam 302, (see FIG. 13). Peg 80 is inserted in hole 398 of the floor 38 and hole 247*a* of beam 247 of wall 24 (see FIGS. 11 and 12), similarly, a peg (not shown) is inserted in hole 399 of floor 38 and hole 267*a* of beam 267.

The rear roof member 34 is installed by inserting the slots 342 and 343 of edge 341 of the beam 340 in slots 246 and 266 of the left and right side wall, respectively. The inner surface of the roof 34 rests on the rear slanted edges 244 and 264 of the left and right side walls, respectively. Similarly, the slots 362 and 363 of edge 361 of the front roof beam 360 are installed in slots 246 and 266, and the roof member 36 rests on front slanted edges 246 and 265 of the left and right side walls, respectively. The two beams 340 and 360 abut each other.

Porch roof 29 is installed on the outside of the front wall 30 along with the columns as follows (see FIGS. 3–6). The porch roof 29 is first turned upside-down and each column is engaged in the beam 291. Column 40, for example, is engaged by inserting peg 400 in hole **292*d* of beam 291. Similarly, columns 41–43 are engaged in beam 291 in holes 292*c*, 292*b* and 292*a*, respectively. The porch roof and columns are righted and longitudinal T-portion 297 of porch beam 296 is inserted in longitudinal slot 309 of beam 308 of front wall 30. At the same time, the bottom pegs of the columns are inserted in the hole along the front of the floor 22, e.g. peg 403 of column 40 is inserted in hole 226*d* and similarly bottom pegs of columns 41–43 are each inserted in holes 226*c*–226*a*,** respectively.

Figures 5, 6:
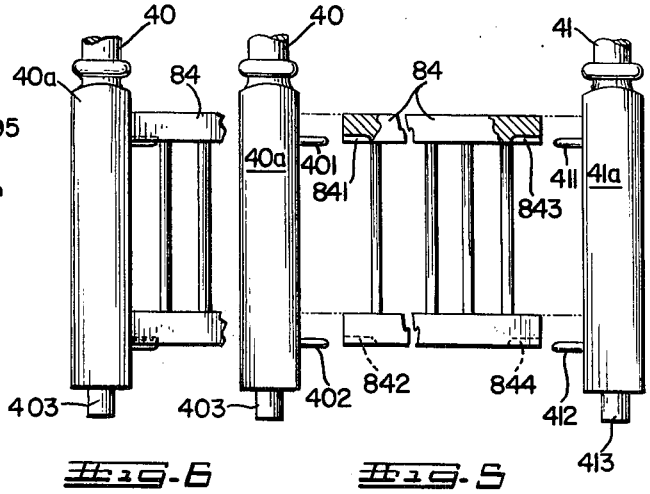
FIG. 5 is an enlarged fragmentary side view of the manner in which the porch rails are installed between porch columns.
FIG. 6 is an enlarged fragmentary side view showing the porch rail installed on a porch column.

The rails 297 and 298 are next inserted between the installed columns as shown in FIGS. 5 and 6. The post **40*a* of column 40 is rotated so that protruding pegs 401 and 402 face towards column 41. Similarly post 41*a* of column 41 is rotated so that the protruding pegs 411 and 412 face towards column 40. Porch rail 84 is mounted by engaging underside grooves 841 and 842 of rail 84 on pegs 401 and 402, respectively, of post 40**.

Similarly, underside grooves 843 and 844 of the rail 84 engage pegs 411 and 412 of post **41*a*. Rail 86 is similarly mounted between the posts of columns 42 and 43**.

The placement of the pegs for holding the doll house together is uniquely designed for easy assembly as well as providing the rigidity required for the doll house. For the most part, a triangular arrangement is provided for the pegs. Thus, pegs 66, 68 and 69; pegs 64, 69 and 68, 65, 66 and 71; 63, 68, 69 and 71, etc., all form a triangular construction.

As shown in FIGS. 2 and 3, a unitary staircase 62 is installed between the first and second floor against intermediate wall 28. The bottom 620 of the staircase rests on the first floor 22 and an upper edge 621 extends through the stair well 320 and rests on ledge 329 of floor 32. A protective L-shaped handrail 622 is also provided around the stair well.

The doll house is knocked-down or disassembled by reversing the above procedure. The unique and novel design provides the benefits of knock-down construction. The use of grooves and slots provide means for easily sliding the various parts together, which support one another. The doll house is rigid in construction and all parts are held together tightly by the simple insertion of a relatively small member of strategically arranged small pegs. When disassembled, the parts of the doll house can be stacked together for easy storage or shipment.

Figure 15:
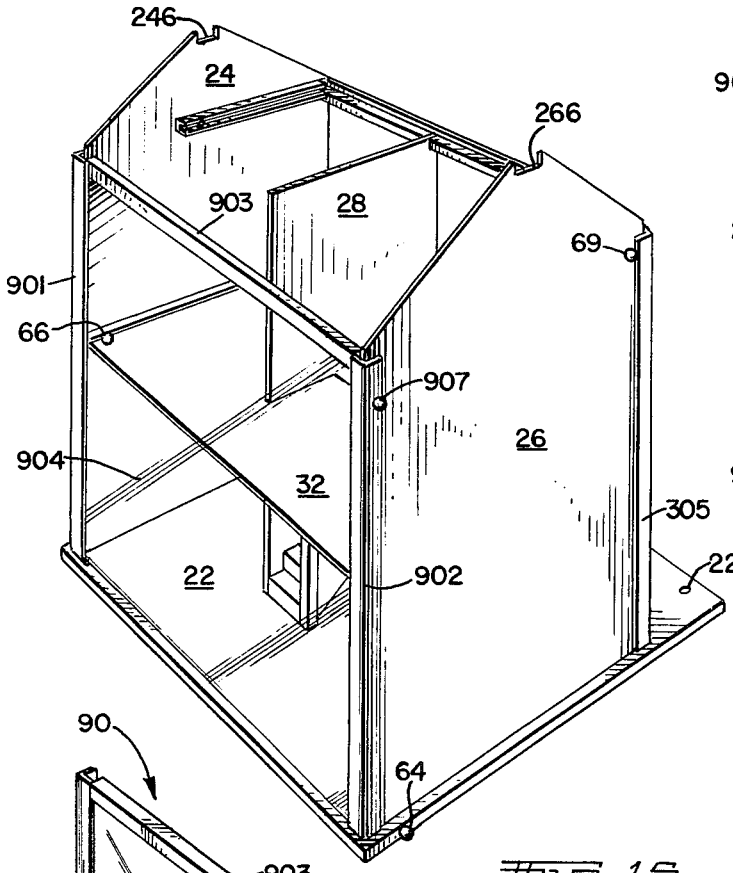
FIG. 15 is perspective view of the partially assembled doll house showing the viewing panel of FIG. 14 installed.
Figure 16:
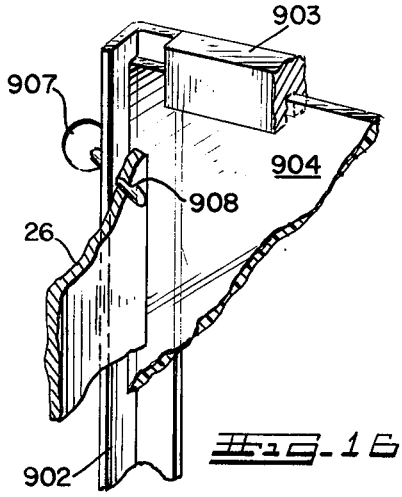
FIG. 16 is an enlarged perspective fragmentary view from the inside of the doll house showing how the viewing panel is installed.
Figure 14:
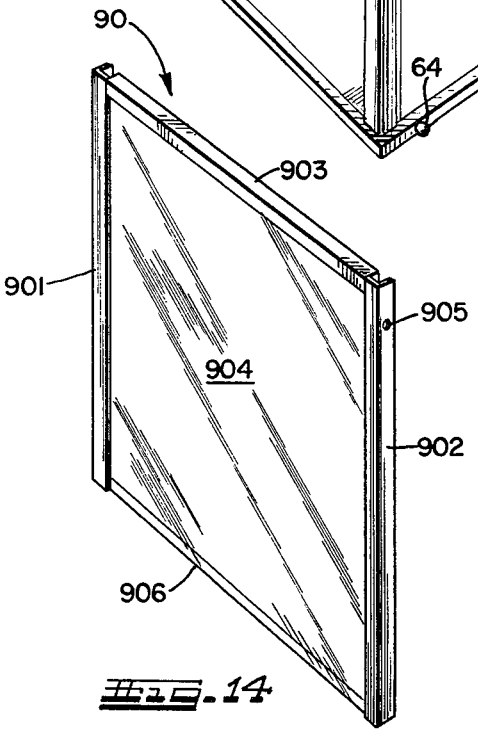
FIG. 14 is a perspective view of a protective viewing panel used with the open rear of the doll house.

FIGS. 14–16 disclose an optional novel transparent panel 90 is provided for installation across the open rear of the doll house. The panel 90 comprises a transparent pane 904 of glass, plexiglass, tec., L-shaped members 901 and 902 secured by suitable means on each side, a member 903 secured across the top, and peg hole 905 in L-shaped member 902 and a similar peg hole (not shown) in member 901.

Panel 90 is installed across the rear of the assembled doll house (shown in FIG. 15 with the roof panels 34 and 36 removed to better depict panel 90 as installed) by placing edge 906 on the rear of floor 22. The panel is placed flush against the rear edges of side walls 24 and 26, whereby L-shaped members 901 and 902 are engaged around the outside edges of walls 24 and 26, respectively. Wall 26 is provided with peg hole 908 and L-shaped member 902 is provided with peg hole 905. A peg 907 is inserted in holes 905 and 908. Similarly, a peg (not shown) is inserted in holes (not shown) in L-shaped member 901 and wall 24. The two pegs hold the panel 90 securely across the rear of the doll house.

The panel 90 provides protection for the inside of the doll house which can contain valuable miniature furniture collections on display. In addition, the panel being transparent, one can easily view the contents of the doll house.

Although the doll house of this invention has been disclosed heretofore as the preferred embodiment, wherein four rooms are available by using the one intermediate wall member 28, it is understood that the doll house can be constructed to contain more than one intermediate wall member thus providing sic or more rooms. Furthermore, the number of columns used can be more or less than four as shown in the preferred embodiment.

The above description of the invention is deemed to be the most practical and efficient embodiment and it should be understood that the invention is not limited to such embodiments as heretofore indicated as there could be further changes made in the arrangements, disposition and form of the parts without departing from the principle of the present invention within the scope of the accompanying claims.

What is claimed is:

1. An easily assembled knock-down doll house having a front porch construction with columns, the parts of which are fitted together and held together only with pegs comprising:

a. a generally rectangular first floor member comprising left, right and front grooves in the top surface thereof, at least one intermediate groove in said surface parallel to said left and right grooves, and a series of in-line holes disposed forward of said front groove;

b. a front wall member having a size and shape to have its bottom edge engage said front grooves of said first floor member, comprising vertical L-shaped side beams, a top horizontal beam member disposed on the inner front wall containing at least one vertical slot, and a horizontal L-shaped beam member disposed on the outer side at an intermediate position;

c. left and right side walls, having respective sizes and shapes to have their front edges engage said L-shaped beams of said front wall and their bottom edges engage said respective left and right grooves of said first floor, each of said side walls containing a top, inner horizontal beam member having an inward side groove, an inner second horizontal beam member having an inward side groove and disposed between said side wall top beam and the lower edge of said side wall, inwardly angled top edges, and a slot disposed at the terminus of said angled top edges;

d. at least one intermediate wall member adapted to have its lower edge engage a respective said intermediate groove in said first floor and a said vertical slot of said front wall top beam member, comprising an intermediate horizontal slot extending forwardly from the rear edge;

e. a second floor member adapted to have its side edges engage said grooves of said inner second beam members of said side walls and comprising a stairwell near the front edge and at least one horizontal slot extending rearwardly from the front edge, said slot adapted to engage said horizontal slot of said intermediate wall member;

f. a third floor member adapted to have its side edges engage said grooves of said inner top beam members of said side walls, and comprising a beam member disposed along the rear edge having at least one slot disposed on the underside thereof adapted to engage the top edge of a said intermediate wall member;

g. front and rear roof panels each comprising a horizontal beam member disposed along the underportion of one edge containing a slot near each end, said panels being constructed and arranged to adapt said roof beams to enter said terminus slots of said side walls and to adapt the slots of said beams to receive the edge of said terminus slots with said respective roof beams disposed adjacent to each other and said panels disposed along said angled edges of said side walls;

h. a porch roof panel member adapted to have its rear portion be disposed on said L-shaped beam member of said front wall member comprising, a rear horizontal beam member having a longitudinal downwardly protruding lip, and a front horizontal beam member having a series of in-line holes disposed along the under side thereof;

i. a series of vertical porch columns having respective sizes and shapes adapting them to be disposed between said front portion of said porch panel member and said first floor member with each column having its bottom portion disposed in one of said first floor series of holes and its top portion disposed in one of said porch front beam member series of holes;

j. a plurality of pegs adapted to be inserted in holes contained in said beams, grooves, wall and floor members at their junctures with each other for retaining said assembled structure together.

2. The doll house of claim 1, wherein said porch roof member comprises a decorative cornice disposed forwardly of said porch front beam member.

3. The doll house of claim 1, wherein each of said porch columns comprise a lower rectangular post, a pair of horizontal pegs vertically disposed on one side of said post, and a vertical peg disposed at each end of said column.

4. The doll house of claim 3, including a rail member, said rail member comprising upper and lower horizontal bar members, each of said bar members comprising end grooves on the underside thereof, whereby said rail member is adapted to be disposed between two adjacent posts of said columns by placing said rail grooves on said horizontal rail pegs.

5. The doll house of claim 1, wherein each of said columns comprise vertical pegs at each end thereof adapted to fit within said in-line holes of said first floor and said porch front beam member.

6. The doll house of claim 1, wherein said porch rear beam member lip is adapted to be disposed in said L-shaped beam member of said front wall member to retain said porch member on said front wall member.

7. In an easily assembled knock-down type of doll house comprising front and side wall members, house roof members, intermediate wall and floor members and a first floor member having a forward section extending beyond the front of said front wall member, the improvement which comprises a front porch including a roof panel member and vertical columns, said front wall member comprising a horizontal L-shaped beam member disposed on the outer surface of said front wall member, said first floor member having a forward section extending beyond the front of said front wall member and comprising a series of in-line holes parallel to said front wall, said roof panel member comprising horizontal longitudinal front and rear beam members, said rear beam member comprising a downwardly protruding lip member, said front beam member comprising a series of in-line holes disposed on the underside thereof, a series of columns having pegs at each end disposed between said porch roof member and said first floor member in said respective in-line holes.

8. The improved doll house of claim 7, wherein a rail member is disposed between adjacent coolumns, said rail member comprising upper and lower bar members each having horizontal grooves at each end on the underside thereof, said columns comprising horizontal extending pegs vertically disposed on said column whereby said groove members of said bar members are adapted to be disposed on said pegs of said columns.

* * * * *